US008997276B2

(12) United States Patent
Stryker et al.

(10) Patent No.: US 8,997,276 B2
(45) Date of Patent: Apr. 7, 2015

(54) PATIENT LIFT

(71) Applicant: Stryker Corporation, Kalamazoo, MI (US)

(72) Inventors: Martin W. Stryker, Kalamazoo, MI (US); Cory P. Herbst, Shelbyville, MI (US); Jeffrey L. Lewandowski, Delton, MI (US); Scott Davis, Oshtemo, MI (US)

(73) Assignee: Stryker Corporation, Kalamazoo, MI (US)

( * ) Notice: Subject to any disclaimer, the term of this patent is extended or adjusted under 35 U.S.C. 154(b) by 195 days.

(21) Appl. No.: 13/736,663

(22) Filed: Jan. 8, 2013

(65) Prior Publication Data

US 2013/0174339 A1 Jul. 11, 2013

Related U.S. Application Data

(60) Provisional application No. 61/584,326, filed on Jan. 9, 2012.

(51) Int. Cl.
*A61G 7/10* (2006.01)

(52) U.S. Cl.
CPC ..... *A61G 7/1019* (2013.01); *A61G 7/1044* (2013.01); *A61G 7/1051* (2013.01); *A61G 7/1055* (2013.01); *A61G 7/1076* (2013.01)

(58) Field of Classification Search
USPC ..... 5/87.1, 84.1, 83.1, 81.1 R
See application file for complete search history.

(56) References Cited

U.S. PATENT DOCUMENTS

| | | | | |
|---|---|---|---|---|
| 2,218,883 | A * | 10/1940 | Jones | 5/87.1 |
| 2,706,120 | A | 4/1955 | Stratton | |
| 5,005,233 | A * | 4/1991 | Toivio et al. | 5/83.1 |
| 5,390,380 | A * | 2/1995 | James-Wallace | 5/84.1 |

(Continued)

FOREIGN PATENT DOCUMENTS

| | | |
|---|---|---|
| JP | 07-016269 | 1/1995 |
| JP | 09-173391 | 7/1997 |
| JP | 2002-263148 | 9/2002 |
| WO | WO 92/16176 | 10/1992 |

OTHER PUBLICATIONS

"Patient Lift" as published on Wikipedia, http://en.wikipedia.org/wiki/Patient_lift, retrieved on Nov. 10, 2011.

(Continued)

*Primary Examiner* — Robert G Santos
*Assistant Examiner* — Ifeolu Adeboyejo
(74) *Attorney, Agent, or Firm* — Warner Norcross & Judd LLP

(57) ABSTRACT

The present invention provides a patient lift for transferring a person from a hospital bed to another patient support structure. The patient lift includes a mast, a boom, a stabilizer leg, and a coupler leg adapted to couple to the hospital bed. The boom is mounted to the top of the mast, and extends outwardly from a central vertical axis of said mast. In one aspect, the boom may rotate independently of the stabilizer leg about the central vertical axis while above the hospital bed and while within an angular distance of a side of the hospital bed. Once the boom moves past the angular distance, the boom and stabilizer leg may begin to rotate together about the central vertical axis. In another aspect, the boom is capable of being positioned in a stowed position above a footboard of the hospital bed.

21 Claims, 6 Drawing Sheets

(56) References Cited

U.S. PATENT DOCUMENTS

| | | | | |
|---|---|---|---|---|
| 5,406,658 | A * | 4/1995 | Olkkonen et al. | 5/83.1 |
| 5,697,110 | A * | 12/1997 | Campbell | 5/81.1 R |
| 5,708,993 | A * | 1/1998 | Campbell et al. | 5/86.1 |
| 5,784,730 | A * | 7/1998 | Hunt | 5/86.1 |
| 6,964,070 | B2 * | 11/2005 | Hawk et al. | 5/81.1 R |
| 2005/0097670 | A1 | 5/2005 | Hawk et al. | |
| 2006/0168728 | A1 | 8/2006 | Strobel et al. | |

OTHER PUBLICATIONS

International Search Report for application No. PCT/US2013/020650 mailed Apr. 29, 2013.

Written Opinion of the International Searching Authority for application No. PCT/US2013/020650 mailed Apr. 29, 2013.

* cited by examiner

PATIENT LIFT

The present application claims the benefit of a PATIENT LIFT, Ser. No. 61/584,326, filed Jan. 9, 2012, which is hereby incorporated by reference herein in its entirety.

BACKGROUND OF THE INVENTION

The present invention generally relates to patient lifts for transferring a person, such as a patient, from one location to another location, for example from a bed to a wheelchair.

Patient lifts are used to transfer persons having medical conditions that may make it demanding or exhausting for them to move without assistive help. When a caregiver assists such a person to move from one location to another, the caregiver is exposed to strain and stress. In an effort to reduce this stain and stress, patient lifts and numerous other devices have been developed to reduce the force for moving the person.

The conventional patient lift is one such device used to transfer a person from one location to another. The conventional patient lift is a stand-alone device that the caregiver rolls or moves into position near, for example, the bed or wheelchair supporting the patient. Once the conventional lift is in position, the caregiver couples the patient to the conventional patient lift, lifts the patient, and then rolls or moves the conventional lift along with the person to another location for transfer. This stand-alone conventional device is generally large and conspicuous, and does not store well within the existing environment. As a result, patients often express apprehension at the prospect of being transferred by a conventional patient lift. Bystanders also sometimes express concern over the patient being transferred by such a device.

SUMMARY OF THE INVENTION

The present invention provides a patient lift for transferring a person from a hospital bed to another patient support structure. The patient lift is adapted to couple to a hospital bed, and may be placed in a stowed position while coupled to a hospital bed.

According to an aspect of the invention, the patient lift includes a mast, a boom, a stabilizer leg, and a coupler leg for coupling to the hospital bed. The boom is mounted to the top of the mast, and extends outwardly from a central vertical axis of the mast. The boom is adapted to support the person above the hospital bed for transfer to another support structure or for transfer from another support structure to the hospital bed. The stabilizer leg and coupler leg also extend outwardly from the central vertical axis of the mast.

The stabilizer leg exerts a downward force on the floor or support surface and the coupler leg exerts an upward force on the hospital bed. In response to the patient being transferred, this load distribution may stabilize the patient lift and prevent tipping.

In one embodiment, the boom may rotate independently of the stabilizer leg about the central vertical axis of the mast, while above the hospital bed, and while within an angular distance of a side of the hospital bed, such as between 0° and 60°, preferably between 5° and 15°. Once the boom moves past the angular distance, the boom and stabilizer leg may begin to rotate together about the central vertical axis of the mast. For example, the boom and the mast may rotate together from a position with the boom over the support apparatus to a position past a side of the support apparatus such that the boom is positioned directly above one of the floor or support surface and another patient support structure.

In another aspect, the boom is capable of being placed in a stowed position above a footboard of the hospital bed. The boom may be shaped to follow the contour of the footboard such that it seats above or adjacent the footboard. With this configuration, the patent lift may be readily accessible for a caregiver to transfer the patient, while at the same time remaining modestly out of sight of the patient and bystanders.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

Figure 1:
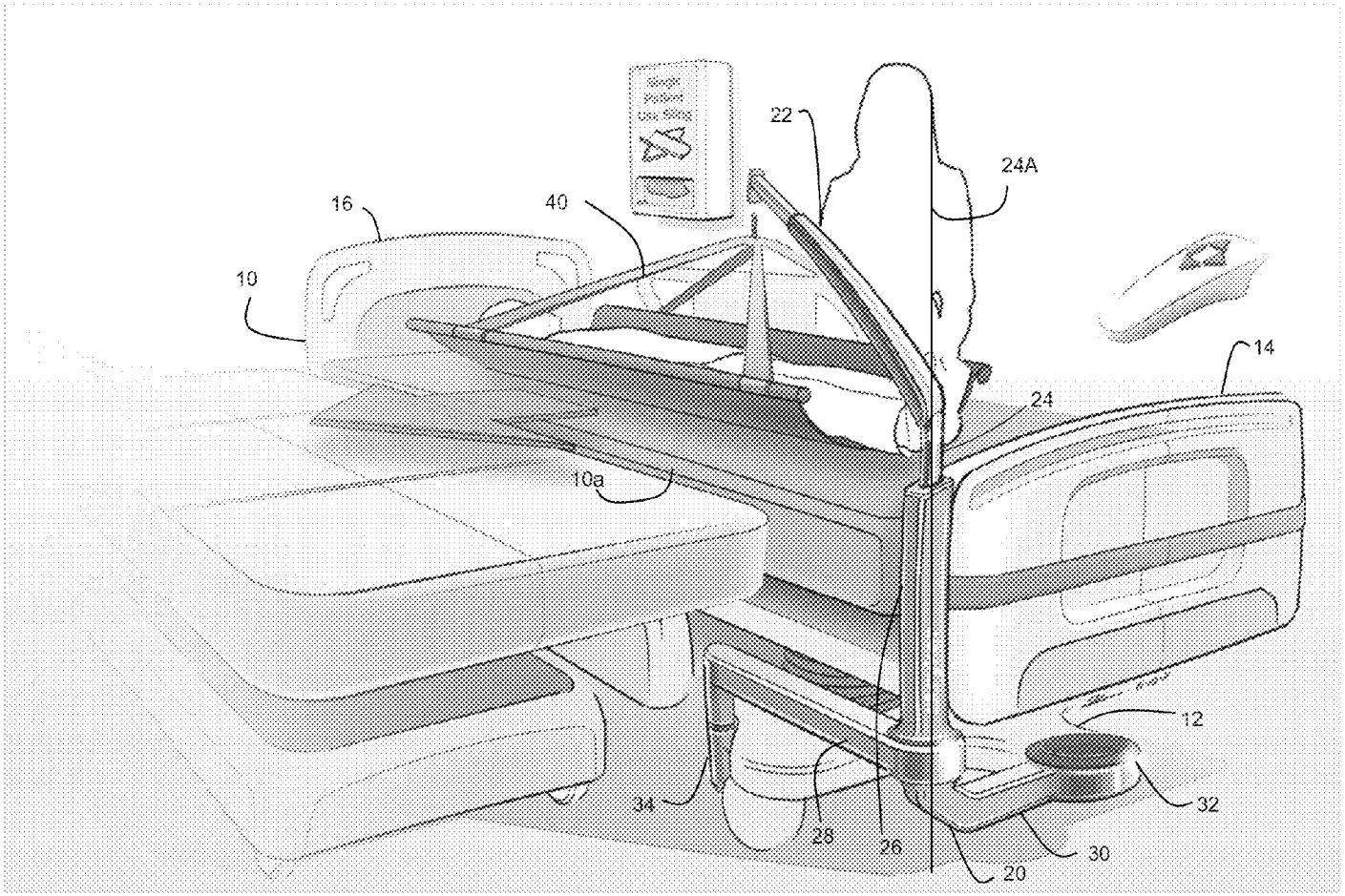
FIG. 1 is a perspective view of the patient lift coupled to a hospital bed, and illustrates the patient lift in a raised position.

Referring to FIGS. 1-2 and 4-7, the numeral 20 generally designates a patient lift of the present invention. As will be described below in further detail, the patient lift 20 couples to a hospital bed 10 for lifting a patient using a transport apparatus 40, and may be moved to a stowed position while coupled to the hospital bed 10 in a manner that is accessible to a caregiver and blends in with the hospital bed 10 in order to be generally inconspicuous.

Hospital bed 10 includes a footboard 14, a headboard 16, a base frame 18, a deck 19, and further a lift coupler 12, which allows patient lift 20 to couple to hospital bed 10. Base frame 18 includes a wheeled base that allows the bed to rest or be rolled on a support surface, such as a floor. Further, hospital bed 10 includes a mattress or lying surface 10*a* upon which a patient is positioned. Hospital bed 10 may also include, for example, a pair of head-end side rails and a pair of foot-end side rails. It is to be appreciated that hospital bed 10 includes many additional features, but for purposes of disclosure, is described with these features in mind. And although patient lift 20 is described in conjunction with hospital bed 10, hospital bed 10 could be any patient support apparatus or structure with a lift coupler, such as lift coupler 12, for coupling with the patient lift 20. Other patient support apparatuses are contemplated for use in conjunction with the patient lift 20, such as those described in U.S. Pat. No. 8,006,332, entitled "Hospital Bed", filed Dec. 19, 2006, and issued Aug. 30, 2011—the subject matter of which is herein incorporated by reference in its entirety.

Lift coupler 12 of hospital bed 10 is adapted to couple with patient lift 20, and further while patient lift 20 is under load, optionally configured to exert a downward force on the patient lift 20 in order to support and stabilize the patient lift 20, and, moreover, to not contribute significant additive forces to the base or deck of hospital bed 10. As described in further detail below, lift coupler 12 may removably, mechanically couple to patient lift 20, and in some embodiments, may allow portions of patient lift 20 to pivot about the lift coupler 12. As shown, the lift coupler 12 forms part of the base frame 18 of the hospital bed 10. In other embodiments, the lift coupler 12 may be removably connected to the base frame 18. For example, lift coupler 12 may disconnect from one hospital bed 10 in order to be connected to another hospital bed 10. As another example, lift coupler 12 may be adapted connect to hospital bed 10 and retrofit hospital bed 10 to couple to patient lift 20. In further alternative embodiments, lift coupler 12 may removably connect to or form a part of deck 19 rather than base frame 18. Deck 19 of hospital bed 10 raises and lowers with the lying surface, and therefore lift coupler 12 also raises and lowers with patient lift 20 and deck 19 in configurations having lift coupler 12 on deck 19. In further alternatives, lift coupler 12 may form a part of or be attached to any portion of hospital bed 10 capable of stabilizing patient lift 20 under load.

Referring to FIGS. 1-7, in the illustrated embodiment, patient lift 20 includes a boom 22, a mast 24, a lift housing 26, a stabilizer leg 28, and a coupler leg 30. With this configuration, patient lift 20 couples to lift coupler 12 of hospital bed 10, and is capable of transporting a person from one location, using for example, a transport apparatus 40, which is illustrated as a sling in FIG. 1.

Boom 22 is mounted to mast 24, and may extend or contract in length, as desired, to accommodate transport apparatus 40 configuration, patient size, and patient support structure. Boom 22 may also raise and lower the transport apparatus 40 by at least one of raising and lowering with mast 24 and pivoting about mast 24. Optionally boom 22 may rotate with mast 24 about the central vertical axis 24*a* of mast 24 such that mast 24 and boom 22 rotate in unison in order to transport the patient from one location to another. But in alternative embodiments, boom 22 may rotate independently of mast 24, or may rotate independently within a range of angular freedom before engaging and rotating with the mast 24.

Returning to the current embodiment, stabilizer leg 28 at least partially supports patient lift 20 under load and prevents tipping. A castor wheel 34 attached to the stabilizer leg 28 allows stabilizer leg 28 to be rolled or roll with stabilizer leg 28 on the support surface while rotating with mast 24 and boom 22, maintaining stability for patient lift 20. Depending on the desired configuration of patient lift 20, stabilizer leg 28 may have a fixed length or an adjustable length. Further alternative embodiments may include more than one stabilizer leg extending from central axis 24*a* of mast 24, and spaced apart from each other. Such spacing may be adjustable.

In one embodiment, mast 24 and boom 22 rotate together within a range of angular freedom before engaging a catch (not shown) coupled to stabilizer leg 28, causing stabilizer leg 28 to rotate with mast 24 and boom 22. As an example, mast 24 and boom 22 may rotate freely while boom 22 remains over hospital bed 10, but as the boom rotates outwardly between 0°-60°, preferably 5°-15°, away from the side of hospital bed 10, the catch (not shown) becomes engaged and stabilizer leg 28 begins to rotate along with mast 24 and boom 22. In this way, stabilizer leg 28 may support patient lift 20 while providing space for boom 22 to extend over a structure (e.g., another bed or wheelchair) in order to transfer the patient without interfering with the structure. Alterative embodiments having multiple stabilizer legs may be configured such that each leg rotates with mast 24 and boom 22, separately at different catch points or together as one.

In alternative embodiments where boom 22 at least partially rotates independently of mast 24, mast 24 and stabilizer leg 28 may rotate together as one. With this configuration, for example, when boom 22 pivots about mast 24 between 0°-60°, preferably 5°-15°, past the side of hospital bed 10, boom 22, mast 24, and stabilizer leg 28 begin to rotate together as one at a catch point within the angular range.

As shown, mast 24 extends above the top of lift housing 26. Depending on design parameters, such as patient size and hospital bed 10, lift housing 26 may contain various structures (not shown) for raising and lowering mast 24. For example, lift housing 26 may contain a hydraulic system for vertically displacing mast 24, along with boom 22. Other example structures include mechanical gears or screw lift type structures for vertically displacing mast 24. Whichever displacing structure is implemented, such structure may or may not provide rotational freedom for mast 24 as discussed above.

In the current embodiment, lift housing 26 does not attach to footboard 14, though it may be configured so that it seats flush against the side of footboard 14 such that it blends in with the structure of hospital bed 10. It is to be appreciated that, alternatively, a side of lift housing 26 may attach to a side of footboard 14, or may not seat flush against the side of footboard 14. In further alternatives, lift housing 26 may include a mating and alignment structure for aligning with footboard 14. For example, the side of lift housing 26 may include a fin that fits within a groove on the side of footboard 14.

Patient lift 20 of the current embodiment also includes a coupler arm 30 that is adapted to couple to hospital bed 10 in order to stabilize patient lift 10. Coupler arm 30 includes a bed coupler 32 for attaching or latching to hospital bed 10, and optionally, pivotally latches to hospital bed 10. More specifically, bed coupler 32 of patient lift 20 may engage or latch with lift coupler 12 of hospital bed 10 such that patient lift 20 may be removably attached to hospital bed 10. Coupler arm 30 may be attached to a castor wheel similar to caster wheel 34 described above. Castor wheel 34 and the caster wheel attached to coupler arm 30 may allow patient lift 20 to be wheeled about when disconnected from hospital bed 10.

In alternative embodiments, patient lift 20 may be permanently attached to hospital bed 10 such that bed coupler 32 and lift coupler 10 are permanently attached to each other. In this alternative, coupler arm 30 may or may not have a castor wheel.

The castor wheel attached to coupler arm 30 of the current embodiment may contact the support surface, such as the floor, to help stabilize patient lift 20 under load. Alternatively, a foot may extend from the bottom of coupler arm 30 or lift coupler 12 to help stabilization. The foot may be configured to retract when patient lift 20 is not in use.

In the current embodiment, bed coupler 32 of patient lift 20 may engage either the top or bottom of lift coupler 12, and in some configurations may engage lift coupler 12 both on its top 40 and bottom 42 or therebetween. Optionally, either lift coupler 12 or bed coupler 32 may include a release mechanism (not shown) which allows a caregiver to readily disengage patient lift 20 from hospital bed 10. Likewise, engagement may be effected by wheeling patient lift 20 to hospital bed 10 such that bed coupler 32 moves into position, above, below, therebetween, or above and below lift coupler 12. Simply moving bed coupler 32 into position may automatically cause the latching mechanism to engage. Alternatively, the caregiver may operate a manual latching mechanism or the release mechanism to engage bed coupler 32 once it is in position to be engaged to lift coupler 12 of hospital bed 10.

Under load, the latching between coupler arm 30 and hospital bed 10 may stabilize patient lift 20 and prevent it from tipping. For example, when patient lift 20 is loaded, coupling arm 30 exerts an upward force on lift coupler 12 of hospital bed 10, and exerts a potential force moment about lift coupler 12. These forces may be opposed by the engagement between lift coupler 12 and bed coupler 32 so that patient lift 20 does not tip or fail as a patient is being transported.

Figure 2:
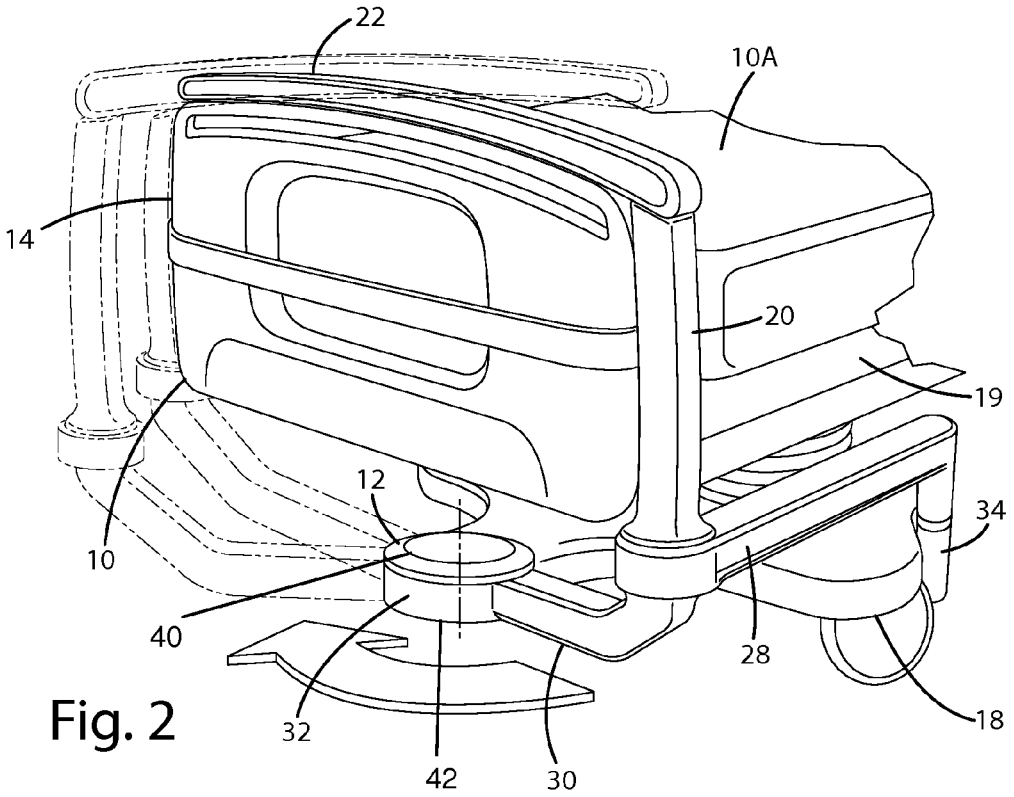
FIG. 2 is a fragmentary view of the bed of FIG. 1 illustrating the patient lift rotated to an opposed side in a stored position.

The engagement between coupler arm 30 and hospital bed 10 also may allow patient lift 20 to rotate about lift coupler 12 of hospital bed 10, and to lock in place at specific locations. For example, as shown in FIG. 1, patient lift 20 is locked in place on the right side of hospital bed 10, while FIG. 2 shows patient lift 20 rotated about lift coupler 12 and locked in place on the opposite side of hospital bed 10. Additionally, the engagement between lift coupler 12 and bed coupler 32 may allow patient lift 20 to be locked in place near the front of footboard 14.

Alternatively, patient lift 20 may be free to rotate about lift coupler 12 without impediment, or it may have angular freedom at various positions of boom 22. For example, as boom 22 rotates further away from the side of hospital bed 10, it may stop rotating with stabilizer leg 28, and then coupler arm 30 may begin to rotate about lift coupler 12.

Figure 4:
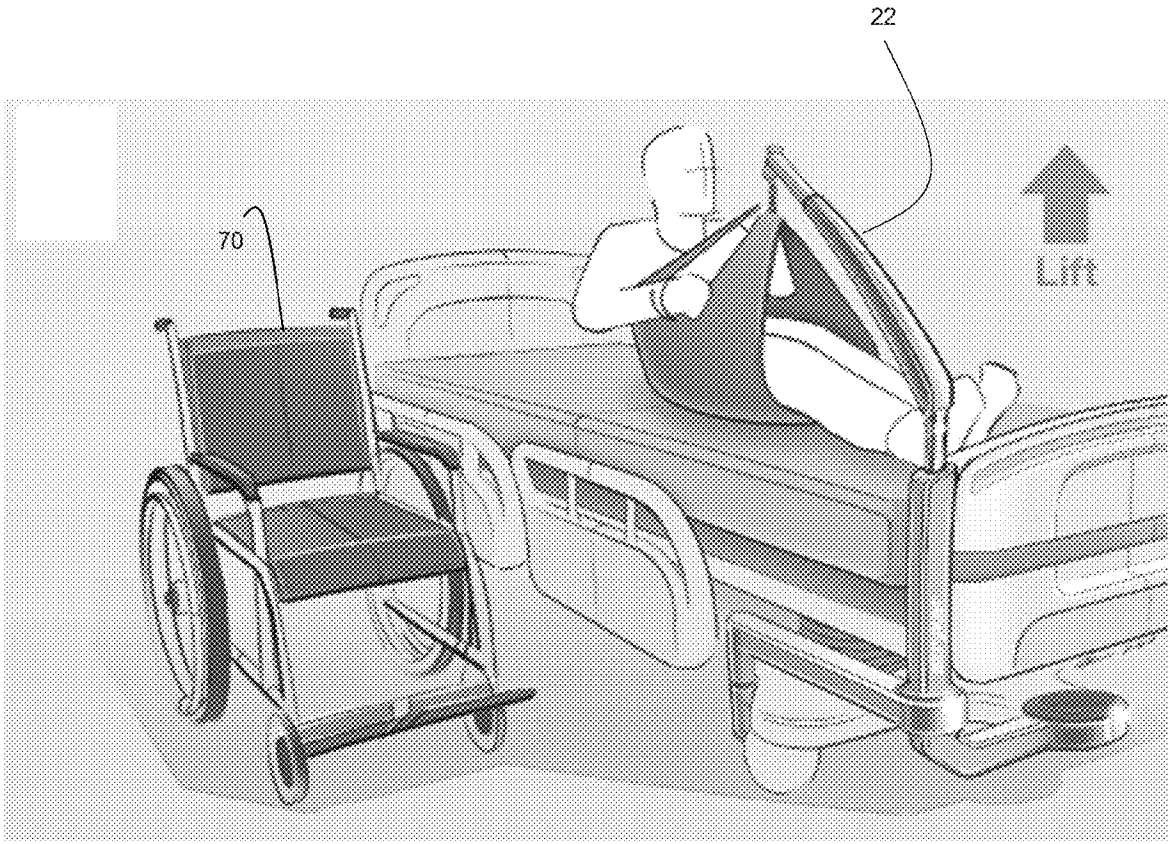
FIG. 4 is a similar view to FIG. 1 illustrating the patient lift moving a patient from the hospital bed to another patient support, such as a wheelchair.
Figure 5:
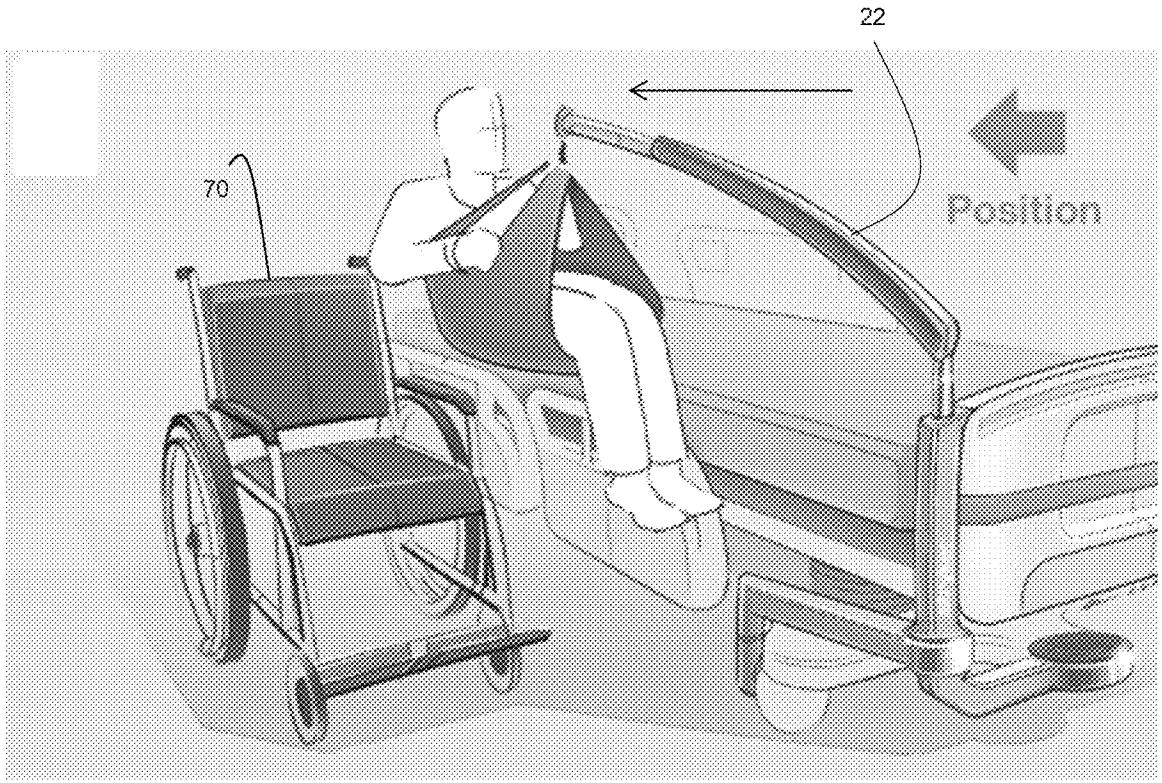
FIG. 5 is a similar view to FIG. 1 illustrating the patient lift moving the patient from the hospital bed to a wheelchair.
Figure 6:
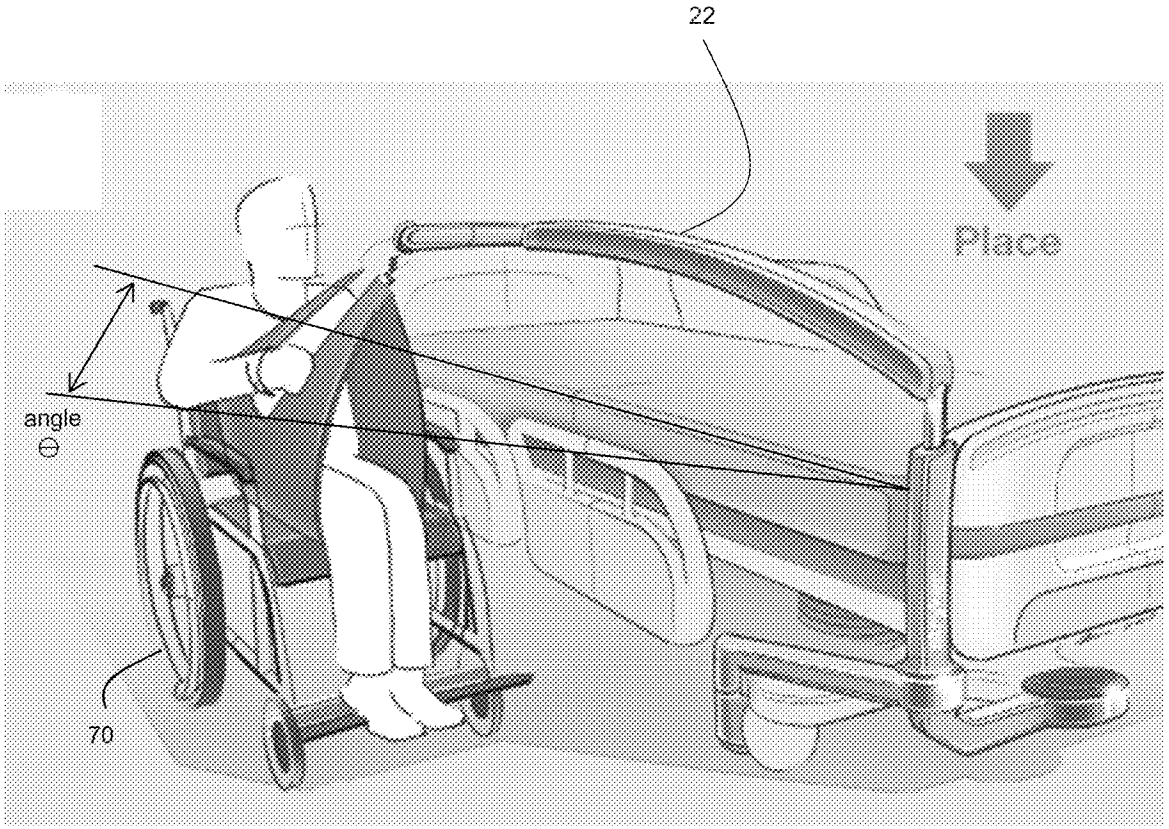
FIG. 6 is a similar view to FIG. 1 illustrating the patient lift moving the patient from the hospital bed to a wheelchair.
Figure 7:
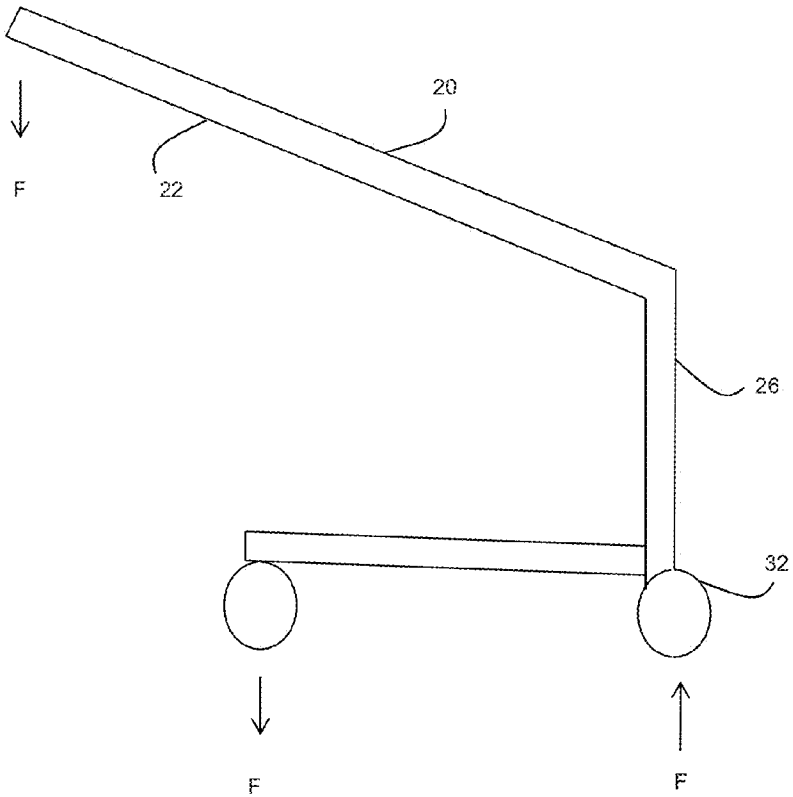
FIG. 7 is a diagram of the patient lift, showing the static forces on the patient lift under load.

Returning again to the current embodiment, operation of patient lift 20 is described in further detail. Starting from the patient being positioned on hospital bed 10, boom 22 and mast 24 are lowered over hospital bed 10 in order to attach to transport apparatus 40, which supports the patient for the upcoming transfer. Boom 22 and mast 24 then are raised to lift the patient so that he/she can be rotated with boom 22 off hospital bed 10 for positioning on another support structure, such as another bed 60, a wheelchair 70, or a chair—which are illustrated in FIGS. 4-6.

As boom 22 and mast 24 rotate past the side of the hospital bed 10 between 0° and 60°, preferably between 5° and 15°, the catch (not shown) of stabilizer arm 28 engages at a catch point within the angular range, and stabilizer arm 28 begins to rotate with boom 22. Stabilizer arm 28 is initially near 0° with respect to the side of hospital bed 10, and so boom 22 remains rotated between 0° and 60°, preferably 5° and 15°, further than stabilizer arm 28, even as stabilizer arm 28 and boom 22 rotate away from the side of hospital bed 10 in unison. If boom 22 were to reverse direction, and rotate toward the side of hospital bed 10, another catch (not shown) may engage, bringing stabilizer arm 28 back to near 0°, and allowing boom 22 to rotate freely over hospital bed 10.

By at least partially moving with boom 22, stabilizer arm 28 remains sufficiently positioned below boom 22 to support the patient and prevent tipping of patient lift 20. In a similar manner, coupler arm 30, which is coupled to hospital bed 10, transfers the load to an object—hospital bed 10—in order to stabilize the patient and prevent tipping of patient lift 20 during the transfer.

In alternative embodiments, boom 22 and mast 22 may be positioned over the hospital bed 10 in order to attach to transport apparatus 40, and hospital bed 10 may then be lowered from underneath the patient such that the patient lift 20 supports the patient. Boom 22 may rotate, as discussed previously, in order to transfer the patient to another support structure. The another support structure, such as another hospital bed, in this embodiment may elevate to the level of the patient for positioning he/she on the another support structure. In other alternative embodiments, hospital bed 10 may lower from underneath the patient for the transfer, and after the patient is positioned above the another support structure, such as a wheel chair, the patient may be lowered into position to complete the transfer. Raising, lowering, and maintaining height, and combinations thereof, of at least one of the hospital bed 10, patient lift 20, and another support structure may be used for transferring a patient from hospital bed 10 to another support structure with patient lift 20. And in further alternative embodiments, the caregiver may use a remote control to direct a controller within the structure of patient lift 20 or hospital bed 10 to control transfer of the patient using patient lift 20 by, for example, controlling at least one of boom 22 height, boom 22 rotation, and hospital bed height.

In alternative configurations where patient lift 20 rotates freely about lift coupler 12 of hospital bed 10, as boom 22 continues to rotate away from the side of hospital bed 10 (e.g., past the 0° to 60° range, preferably the 5° to 15° range) and the angular distance between the side of the hospital bed 10 continues to increase, boom 22 may hit a catch that prevents it from further rotation about central axis 24*a* of mast 24. At this point, patient lift 20 may begin to rotate or pivot about lift coupler 12 of hospital bed 10, allowing further movement of the patient away from hospital bed 10 for transfer to another support structure. For example, as boom 22 reaches 65° with respect to the side of hospital bed 10, boom 22 and stabilizer leg 28 may cease to rotate about central axis 24*a* of mast 24, and patient lift 20 may rotate about lift coupler 12.

Although described in the context of transferring a patient from hospital bed 10 to another support structure, the patient lift 20 may be used to support the patient for at least one of bed maintenance and patient care. For example, patient lift 20 may raise the patient off hospital bed 10, or hospital bed 10 may lower from underneath the patient, in order to change the bed sheets or care for the patient's backside. As another example, a caregiver may care for a patient's bed sores, depending on the type of transport apparatus 40 being used, while the patient is supported above hospital bed 10.

Figure 3:
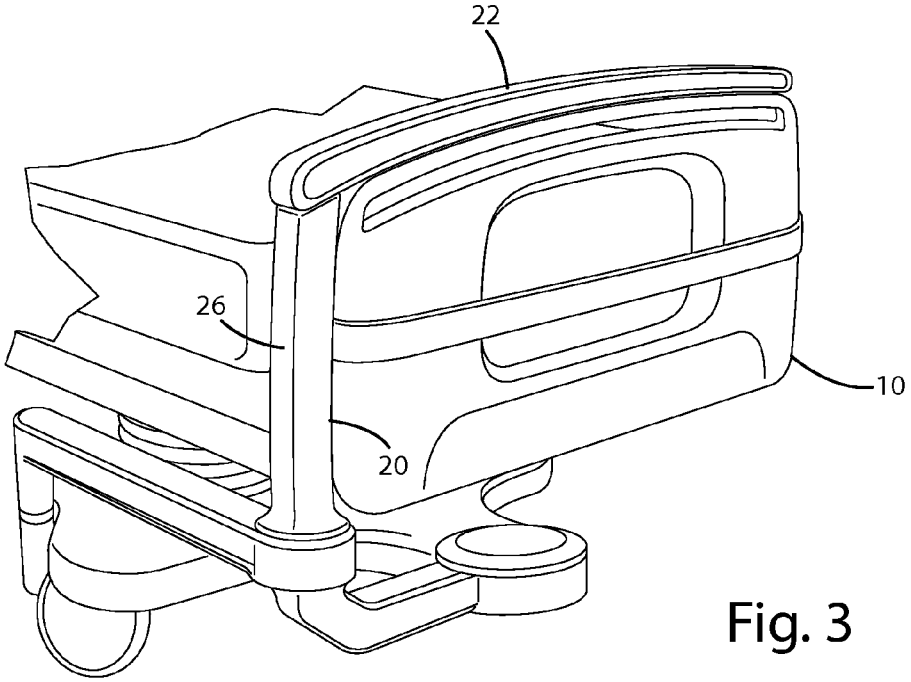
FIG. 3 is a similar view to FIG. 2 illustrating the hospital bed with the patient lift in a stowed position.

Referring now to FIGS. 2-3, the stowed position of patient lift 20 is described in further detail below. In the stowed position, stabilizer arm 28 of patient lift 20 fits underneath hospital bed 10 within the footprint of the deck while lift coupler 12 and bed coupler 32 remain engaged. Boom 22 and mast 24 may lower and rotate such that boom 22 seats above or adjacent footboard 14, following the contour of footboard 14. Although not shown, boom 22 may include mating surfaces that aid alignment with footboard 14 in the stowed position. Alternative embodiments are contemplated in which boom 22 does not follow the contour of footboard 14, or stows in front of or adjacent to footboard 14 rather than above it.

Because patient lift 20 is readily stowable while coupled to hospital bed 10, patient lift 20 may not be readily noticeable to the patient or bystanders. Further, patient lift 20 is readily accessible to the caregiver for transferring the patient from hospital bed 10 to another location—such as another bed 60, a wheelchair 70, or a chair.

For purposes of disclosure patient lift 20 has been described in conjunction with transport apparatus 40 to transfer a patient off hospital bed 10. However, transport apparatus 40 may be any type of sling, harness, or support for transferring the patient off a support structure, such as hospital bed 10. For instance, transport apparatus 40 may be a sling or a support of the type described in U.S. Patent Application Publication 2010/0287698, entitled "Transport Apparatus", filed on May 5, 2010—the subject matter of which is herein incorporated by reference in its entirety.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to packages of any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A lift apparatus for transferring a person from a support apparatus to another support apparatus, said lift apparatus comprising:

a mast having a central vertical axis;

a boom mounted to said mast extending outwardly from said central vertical axis of said mast, said boom capable of supporting a person above the support apparatus when said boom is positioned over the support apparatus;

a leg extending outward from said central vertical axis of said mast;

a coupler leg extending outward from said central vertical axis of said mast, and said coupler leg adapted to mechanically connect said lift apparatus to the support apparatus such that said lift apparatus is integral to the support apparatus; and wherein said boom is configured to conform to the contour of an end component of the support apparatus such that the boom is capable of being stored directly adjacent the end component of the support apparatus along a substantial length of the boom, wherein the end component includes one of a headboard of the support apparatus and a footboard of the support apparatus.

2. The lift apparatus as claimed in claim 1 wherein said leg is a stabilizer leg adapted to exert a downward force on a support surface in response to said person being supported by said boom; wherein said leg and said boom are adapted to rotate about said central vertical axis of said mast; and wherein said leg and said boom are adapted to rotate in unison in at least one direction over an angular range.

3. The lift apparatus as claimed in claim 2 wherein:

said boom rotates about said central vertical axis of said mast;

said boom and said mast rotate together from a first position, wherein said boom is positionable over the support apparatus, to a second position, wherein said boom is positionable past a side of the support apparatus.

4. The lift apparatus as claimed in claim 3 wherein said boom rotates independently from said leg and within an angular distance from said side of said support apparatus such that said boom is directly above said one of said support surface and said another support structure.

5. The lift apparatus as claimed in claim 4 wherein said angular distance is a range between 5° and 15° from said side of said support apparatus.

6. The lift apparatus as claimed in claim 1 wherein said mast and said boom are movable to a stowed such that the boom is adapted to rest above the footboard of the support apparatus, wherein said boom is rotatable to a position above the footboard and said mast lowers said boom to said stowed position.

7. The lift apparatus as claimed in claim 1 further comprising a support coupler adapted to engage a lift apparatus coupler of the support apparatus.

8. The lift apparatus as claimed in claim 7 wherein said support coupler is adapted to releasably engage the lift apparatus coupler.

9. The lift apparatus as claimed in claim 7 in combination with the support apparatus wherein said support coupler exerts an upward force on the lift apparatus coupler in response to the person being supported by said boom.

10. The lift apparatus as claimed in claim 7 combination with the support apparatus wherein said support coupler is adapted to automatically engage the lift apparatus coupler as said lift apparatus is rolled into an engagement position with the support apparatus.

11. The lift apparatus as claimed in claim 7 wherein said support coupler is adapted to engage the lift apparatus coupler on at least one of an upper surface of the lift apparatus coupler, a lower surface of the lift apparatus coupler, and a surface between the upper surface and the lower surface of the lift apparatus coupler.

12. The lift apparatus as claimed in claim 7 wherein said coupler leg includes said support coupler.

13. The lift apparatus as claimed in claim 7 in combination with the support apparatus wherein said engagement between said support coupler and the lift apparatus coupler allows said coupler leg rotate about the lift apparatus coupler.

14. A patient lift device for transferring a patient from a support apparatus to another support apparatus, said patient lift device comprising:

a mast;

a boom mounted to said mast, said boom capable of supporting said patient above said support apparatus;

a leg extending outward from said mast;

a coupler leg extending outward from said mast, said coupler leg adapted to mechanically connect said patient lift device to the support apparatus such that said patient lift device is integral to the support apparatus, wherein said boom is capable of being placed in a stowed position adjacent an end component of the support apparatus, the end component including one of a footboard of the support apparatus and a headboard of the support apparatus; and wherein said boom is configured to conform to the contour of the end component of the support apparatus such that the boom is capable of being stored directly adjacent the end component of the support apparatus along a substantial length of the boom.

15. The patient lift device as claimed in claim 14 wherein said boom is capable of seating directly above and in contact with the end component of the support apparatus along the substantial length of the boom.

16. The patient lift device as claimed in claim 14 wherein said boom includes a mating structure configured to aid alignment with the footboard of the support apparatus.

17. The patient lift device as claimed in claim 14 wherein said leg is attached to a castor wheel adapted to roll on said support surface, and wherein said coupler leg is attached to another castor wheel adapted to roll on said support surface.

18. The patient lift device as claimed in claim 14 wherein an end of said boom distal from said mast is adapted to attach to a transport apparatus for transferring the patient from the support structure to the another support structure.

19. The patient lift device as claimed in claim 14 wherein said boom rotates, said leg rotates, and said coupler leg are adapted to rotate about the support apparatus, wherein said boom and said leg rotate together within an angular range, and wherein said coupler leg rotates outside said angular range.

20. The patient lift device as claimed in claim 14 wherein said support apparatus is a hospital bed.

21. The patient lift device as claimed in claim 14 wherein said another support apparatus includes one of another hospital bed, a wheelchair, and a chair.

* * * * *

UNITED STATES PATENT AND TRADEMARK OFFICE

CERTIFICATE OF CORRECTION

PATENT NO. : 8,997,276 B2
APPLICATION NO. : 13/736663
DATED : April 7, 2015
INVENTOR(S) : Martin W. Stryker et al.

It is certified that error appears in the above-identified patent and that said Letters Patent is hereby corrected as shown below:

In the Claims

Column 8, claim 6, line 36 should read:

"mast and said boom are movable to a stowed such that the" should be -- mast and said boom are movable to a stowed position such that the --

Column 8, claim 10, line 51 should read:

"10. The lift apparatus as claimed in claim 7 combination" should be -- 10. The lift apparatus as claimed in claim 7 in combination --

Column 8, claim 13, line 67 should read:

"coupler leg rotate about the lift apparatus coupler." should be -- "coupler leg to rotate about the lift apparatus coupler. --

Signed and Sealed this
Twenty-fifth Day of August, 2015

Michelle K. Lee

Michelle K. Lee
*Director of the United States Patent and Trademark Office*